US005989160A

United States Patent [19]

Wang et al.

[11] Patent Number: 5,989,160

[45] Date of Patent: Nov. 23, 1999

[54] BELT GUIDING DEVICE FOR TREADMILL

[75] Inventors: Leao Wang, Taichung; Peter Wu, Taiping, both of Taiwan

[73] Assignee: Greenmaster Industrial Corp., Taichung, Taiwan

[21] Appl. No.: 09/022,376

[22] Filed: Feb. 12, 1998

[51] Int. Cl.[6] ..... A63B 22/02

[52] U.S. Cl. ..... 482/54

[58] Field of Search ..... 482/51, 54

[56] References Cited

U.S. PATENT DOCUMENTS

| | | | |
|---|---|---|---|
| 5,088,729 | 2/1992 | Dalebout | 482/54 |
| 5,454,772 | 10/1995 | Rodden | 482/54 |
| 5,484,362 | 1/1996 | Skowronski et al. | 482/54 |
| 5,752,897 | 5/1998 | Skowronski et al. | 482/54 |

*Primary Examiner*—Glenn E. Richman
*Attorney, Agent, or Firm*—Dougherty & Troxell

[57] ABSTRACT

The present invention relates to an improved belt guiding device for treadmill including a rubber roller jacket on both rollers and the rubber rollers jackets are of proper thickness and the length is slightly less than the length of the rollers. So two ends of the rollers are exposed and is equal in length, also, the length of belt strip is narrower than the lengths of rollers and wider than the length of roller jacket. Therefore, after the belt strip is installed and tightly wrapped on the two rollers, the two roller jackets will generate the bent parts of equal length on the belt strip and these bent parts are able to accurately and effectively guide the belt strip along the rollers during the rotation of the belt strip.

2 Claims, 2 Drawing Sheets

22
42
40
30
20
42
22

22
42
40

20
42
40
42
4
5
4
20

BELT GUIDING DEVICE FOR TREADMILL

BACKGROUND OF THE INVENTION (a) Field of the Invention

This invention relates generally to an improved belt guiding device for treadmill, and more particularly, to a newly invented belt guiding device for treadmill that is structurally simple and has a good belt guiding capability.

(b) Description of the Prior Art

A treadmill is an indoor belt-containing exercise machine that consists of rollers and a belt strip running through these rollers. So, it is desirable that the belt strip remains at the same position when users walk or run on it. Therefore, to prevent the unwanted displacement or shifting of a belt, a belt guiding device is needed to keep a belt at a fixed position.

FIG. 1 shows an embodiment according to prior art of a commonly used belt guiding design. As shown, an angled strip 11 is soldered on both side of the base of the support board 10. These two angled strips 11 press against both sides of the belt, so the object of belt guiding is achieved. However, the advantages of this embodiment including these angled strips are difficult to solder, and these angled strips can be bent, displaced or damaged by transporting or moving this machine.

Therefore, FIG. 2 shows another embodiment of the prior art that has been on the market. This embodiment consists a larger guiding disk 14 on both sides of the front rollers 13; these two guiding disks 14 restrain the belt 15 in position so that the belt guiding is achieved. These two guiding disks do have belt guiding function; however, these guiding disks 14 are not a part of the rollers 13 and considered as "extra parts". In addition to the existing rollers, the assembling of these guiding disks is time-consuming and, in turn, increase the manufacturing cost and these guiding disks adversely affect the appearance of the treadmill machine.

SUMMARY OF THE INVENTION

The object of present invention is to provide a structurally simple belt guiding device with low manufacturing cost, ease of assembling and without affecting the appearance of the treadmill machine.

DESCRIPTION OF THE PREFERRED EMBODIMENT

Figure 1:
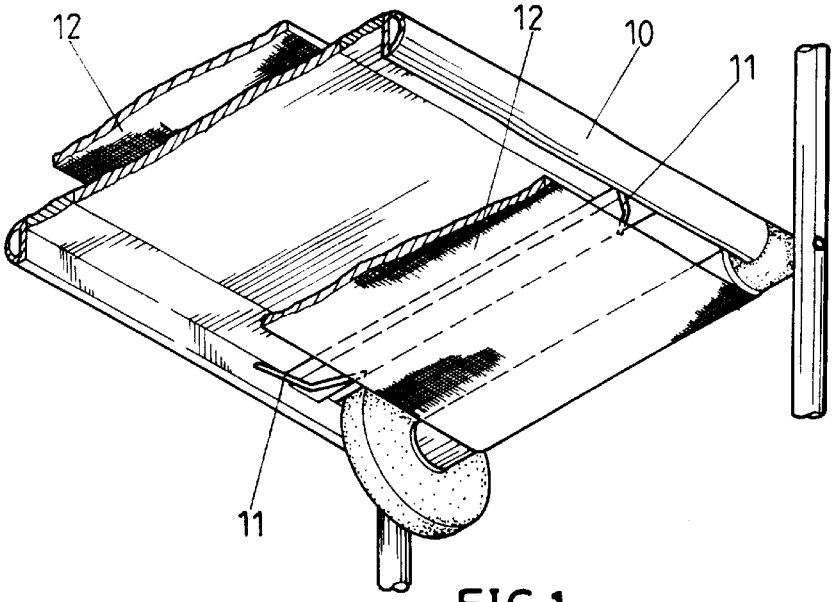
FIG. 1 PRIOR ART
FIG. 1 is a perspective view of belt guiding design of a treadmill according to prior art.
Figure 2:
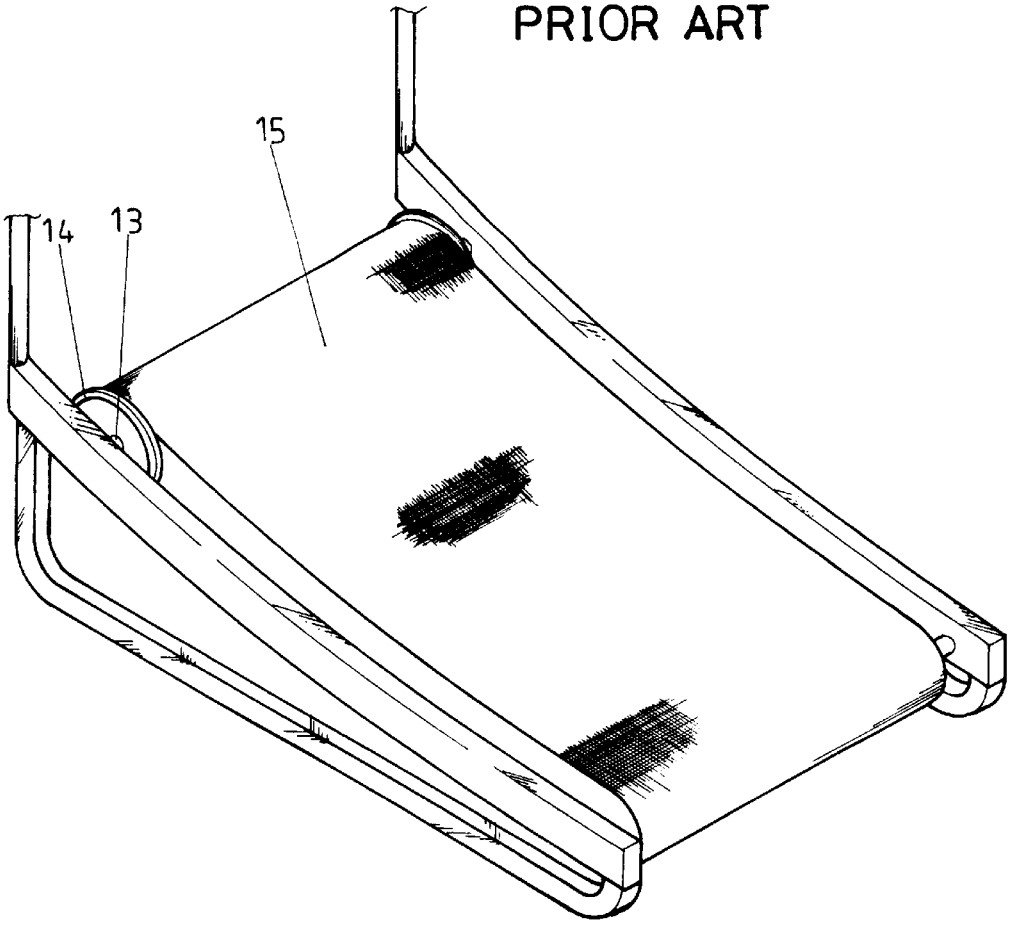
FIG. 2 PRIOR ART
FIG. 2 is a perspective view of another belt guiding design of a treadmill according to prior art.
Figures 3, 4, 5:
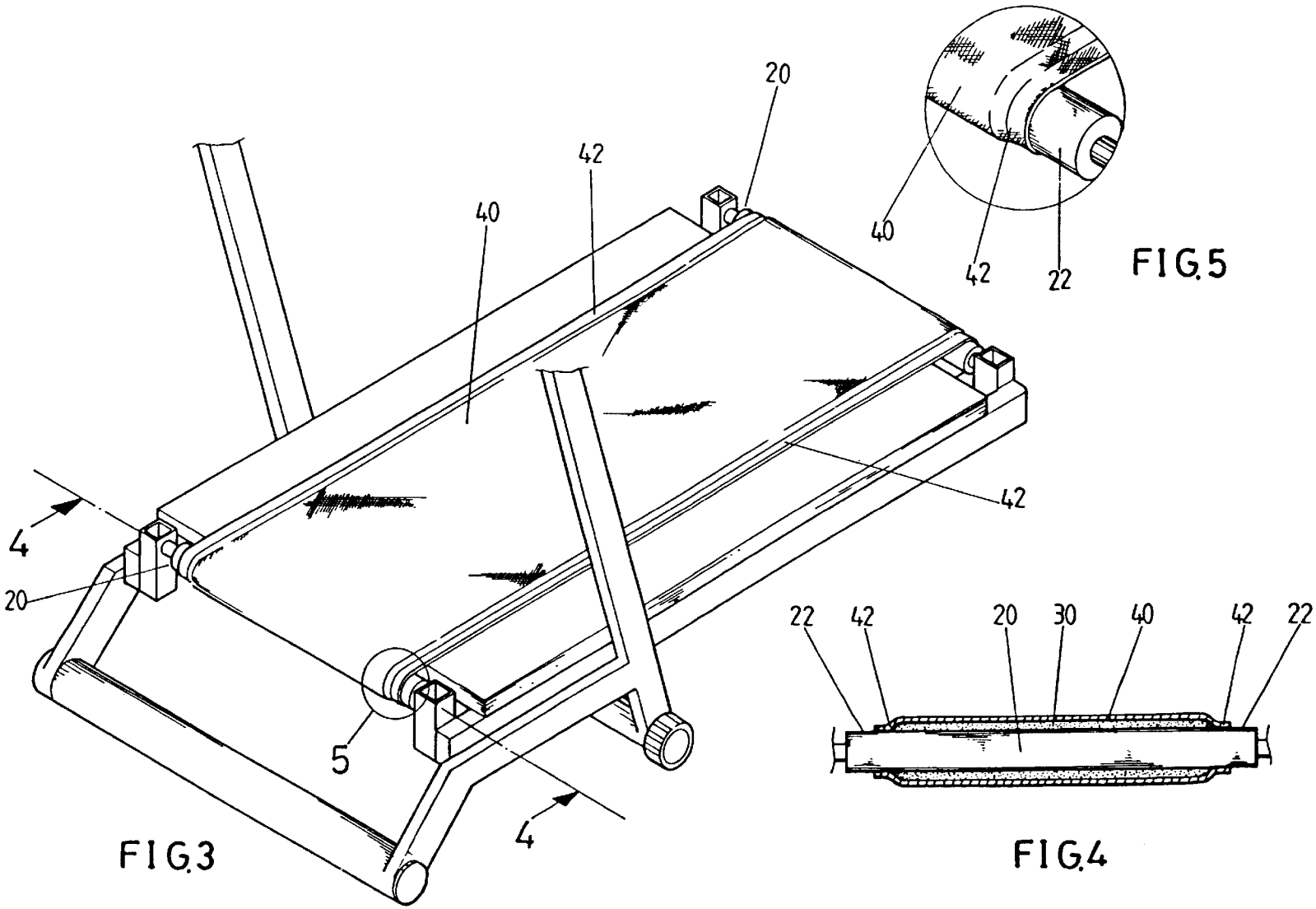
FIG. 3 is a schematic perspective view of belt guiding device of treadmill of the present invention.
FIG. 4 is a partially view according to FIG. 3.
FIG. 5 is a partially enlarged view according to FIG. 3.

The preferred embodiment of the present invention is shown in FIGS. 3 to 5. The embodiment consists of a rubber roller jacket 30 on both rollers 20 and the rubber roller jackets are of proper thickness and the length is slightly less than the roller length so that parts of roller 22 are exposed and two exposed parts at each end of the roller 20 are wider than the length of the roller jacket 30. Therefore, after the belt strip 40 being installed and tightly wrapped on the two rollers 20, the two roller jackets 30 will generate the bent parts 42 on the belt strip and these bent parts 42 are able to accurately and effectively guide the belt strip along the rollers during the rotation of the belt strip.

Moreover, the front and rear rollers are of the same length, and the rubber roller jacket on the both rollers are of the same length and properly lined with each other. So, the bent parts 42 formed by the belt strip and the two rollers can guide the strip effectively. In addition, these bent parts 42 on the front and rear rollers are always present and can regulate each other through tension, so the belt strip can not move sideways and an automatic belt guiding objective is therefore achieved. Also, the roller jackets can increase the friction between the rollers and the belt strip and this will in turn make the rotation of the belt strip smoother.

Also, the said roller jackets can increase the friction between the rollers and the belt strip will in turn make the rotation of the belt strip smoother.

What is claimed is:

1. A treadmill having a frame and comprising:

a) at least two spaced apart rollers located on the frame, each of the at least two rollers having a roller length;

b) a jacket located on an outer surface of each of the at least two rollers, each jacket having a jacket length less than the roller length so as to leave opposite end portions of the rollers uncovered by the jacket; and, c) an endless belt extending between the at least two spaced apart rollers and around a portion of the rollers, the endless belt having a belt width greater than the jacket length and less than the roller length, such that opposite side portions of the endless belt contact the uncovered end portions of the at least two rollers and a middle portion of the endless belt contacts the jackets on the at least two rollers, thereby forming laterally spaced bent portions in the belt which laterally guide the endless belt during movement.

2. The treadmill of claim 1, wherein the jackets each comprise a rubber material.

* * * * *